United States Patent [19]

Dimitrov

[11] Patent Number: 4,499,717

[45] Date of Patent: Feb. 19, 1985

[54] METHOD OF AND APPARATUS FOR PRODUCING TWISTLESS YARNS FROM GLUED SEPARATE FIBERS FITTED TOGETHER

[75] Inventor: Milko D. Dimitrov, Sofia, Bulgaria

[73] Assignee: N P S P "Novotex", Sofia, Bulgaria

[21] Appl. No.: 400,977

[22] Filed: Jul. 22, 1982

[30] Foreign Application Priority Data

Jul. 22, 1981 [BG] Bulgaria ..... 53025

[51] Int. Cl.[3] ..... D02G 3/40; D01H 5/28; D01H 13/28; D01H 13/30

[52] U.S. Cl. ..... 57/297; 57/298; 57/328; 156/166

[58] Field of Search ..... 57/295–298, 57/328, 333; 156/166

[56] References Cited

U.S. PATENT DOCUMENTS

| | | | |
|---|---|---|---|
| 2,515,299 | 7/1950 | Foster et al. | 57/333 |
| 3,447,310 | 6/1969 | Bok et al. | 57/297 |
| 3,716,981 | 2/1973 | Bok | 57/328 X |
| 3,802,174 | 4/1974 | Landwehrkamp et al. | 57/297 X |
| 3,877,214 | 4/1975 | Van Der Werf | 57/328 X |
| 4,007,580 | 2/1977 | Nijhuis | 57/328 X |
| 4,051,658 | 10/1977 | Terwee et al. | 57/328 X |
| 4,064,684 | 12/1977 | Nijhuis | 57/297 X |
| 4,103,396 | 8/1978 | Nijhuis | 57/328 X |
| 4,107,914 | 8/1978 | Van Dort | 57/328 X |
| 4,228,643 | 10/1980 | Nijhuis et al. | 57/297 |

FOREIGN PATENT DOCUMENTS

| | | |
|---|---|---|
| 2171126 | 9/1973 | France . |
| 425569 | 5/1967 | Switzerland . |
| 1380004 | 1/1975 | United Kingdom . |

*Primary Examiner*—John Petrakes

[57] ABSTRACT

Method of and apparatus for producing twistless yarns from glued together separate fibers. Tape from interrupted or continuous fibers is fed by a pair of rollers, and moving in a straight line, is turned circularly or gyrated by a whirling air flux and as a result is false twisted. The false twisted tape, rotating circularly, passes through a recirculating glue solution by entering the top surface of a pool thereof. Passing through the glue solution, the tape is covered with glue, and carries away part of the glue solution toward a calender pair of rollers, which are thus kept always in a constant wet condition. Glue solution running out from the calender pair of rollers deviates from the trajectory of the moving tape, and glides along the working surface of the lower calender roller. The quantity of the glue thus taken away form the fibrous tape can be controlled and regulated. After being dried, the tape is carried through a thread guiding tube to a twisting spindle which delivers the twisted tape to a tape or yarn reserve. Tape is constantly removed from the coiled tape reserve, and is fed to a winder where it is formed into a tape or yarn package.

40 Claims, 3 Drawing Figures

METHOD OF AND APPARATUS FOR PRODUCING TWISTLESS YARNS FROM GLUED SEPARATE FIBERS FITTED TOGETHER

This invention pertains to a method of and an apparatus for producing twistless yarns from glued separate fibers fitted together.

A method is disclosed in British Pat. No. 1,380,004 for producing twistless yarns of glued fibers, wherein the fibers are fitted together by adding a solution of glue to staple fibrous material before or during its drawing when wet. The drawn fibrous material is subjected to a false twisting, winding and drying.

The apparatus, by which the method is practiced, comprises a line for supplying the recirculating glue solution, next to which there is placed a drawing apparatus, followed by a jet for false twisting by air and a device for winding the ready-made yarn.

A disadvantage of this method is that the glueing component cannot be uniformly distributed along the length of the fibrous material, and when in touch with the rollers of the drawing apparatus and with the device for false twisting it sticks to them, thus creating conditions leading to the uncontrollable guiding of the fibers. The soiling of the elements of the apparatus leads to disturbances of the process, and the dried strip, covered with glue, in the form of a bobbin leads to a clotting of the winding and their breaking when it is unwound.

Another method is disclosed in Netherlands patent application No. 7,713,263 for obtaining twistless threads fitted together by a glue, wherein to the fibrous material there is added in advance potentially active sticking fibers or a potentially active sticking powder. The fibrous material thus formed can be drawn when wet or can first be drawn in dry condition in the so-called first drawing zone, and thereafter made tight by a false twisting in a water vortex, and fed to the second drawing zone. After leaving the drawing apparatus, the fibrous strip or tape is again subjected to tightening by false twisting carried out in a steam vortex, which causes a partial activating of the sticking component. The fibrous tape is next put in engagement with the heated surface of a drying cylinder where the activating of the sticking component is completed and the tape is dried. The apparatus for carrying out this method comprises two jets for false twisting, between which there is located a drawing apparatus, and after the second jet there is disposed a drying cylinder.

A disadvantage of this method is that there cannot be obtained a uniform distribution of the preliminarily added sticking component in the form of fibers, even though using expensive blending installations, and the usage of potentially active sticking powder leads to soiling of the working elements of the apparatus. Also, conditions are created for the adhering of the potentially active sticking component to the walls of the steam jet for false twisting, where the activation of such component begins. The utilization of special sticking fibers also leads to making the production more expensive, bearing in mind moreover that these types of fibers have uncontrollable characteristics of thermoplasticity and solubility, thus varying the quality of the yarn. The repetition of the process using the same bobbin is impossible.

Another method, also for making twistless yarns from fitted together staple fibers by glueing, is disclosed in Swiss Pat. No. 425,569. In such method the tape is carried through a guiding funnel to a tightening funnel, to the upper part of the latter there being connected a tube for feeding a glue solution to the moving tape. A part of this glue solution is separated from the fibrous tape through radially placed slots in the tightening funnel, or through spirally cut grooves in it. Then the fibrous tape passes through a pair of calender rollers, with a minimum length of their generants, to their front surfaces, where there are located plates. The calender rollers and the plates form a narrow chute, in the passage through which the tape again is made tighter and another part of the glue solution is separated from it.

A disadvantage of this method is that the tape is made tighter during the laying on and separating of the glue solution from it. This creates a condition wherein the shorter fibers on the surface of the tape tend to adhere to the tightening funnel and to the calender pair of rollers as well as to the laterally situated plates. This causes a clogging and uncontrollable guiding of the fibers in the tape.

A further method of obtaining twistless yarns from fitted together staple fibers by glueing is disclosed in Frech Pat. No. 2,171,126, wherein in order to avoid soiling of the working elements of the apparatus, the glue solution is laid on the calendering pair of rollers themselves, which in the meantime have to make the tape tighter and to separate the surplus glue solution from it. However, in this case the fibers adhere to the working surfaces of the calender pair of rollers, part of which fill up the space between the front surfaces of the calender rollers and the lateral plates connected to them. The glue solution cannot penetrate to the inner side of the fibrous tape because of the brief contact of the tape with it. In order to avoid the wedging of fibers between the lateral plates and the front surfaces of the calender rollers, there is created a high hydrodynamic pressure in the glue solution by making the inner surfaces of the lateral plates oblique.

A disadvantage of this method is that the fibrous tape enters the calender pair of rollers in untightened form, thus keeping the conditions for adherence of fibers to the working surfaces of the calender rollers due to the existing elastic extension of the fibers in the tape. Such latter condition is manifested when the fibrous tape leaves the calender pair of rolls.

The present invention has among its objects the provision of a method of and an apparatus for producing twistless yarns from glued separate fibers fitted together, wherein the glue solution has to be uniformly laid on the separate fibers of the tightened tape, which has to be dried and wound onto a bobbin in the course of a continuous process.

In the method in accordance with the invention, the tape formed from interrupted and/or unbroken fibers is fed by a pair of rollers, and, moving in straight line, is turned circularly by a whirling air flux or vortex and as a result is false twisted. The air flux rotates after its tangential entering into a limited area at a constant pressure and is oriented in the direction opposite the movement of the tape.

The false twisted tape, rotating circularly, passes through a recirculating solution and comes into contact with the latter under its top level, the height of which is kept constant. Passing through the jet for laying on a glue solution, the tape is covered with glue and carries away part of the glue solution towards a calender pair of rollers, which are thus always kept in a constant wet condition. The glue solution running out from the calender pair of rollers deviates from the trajectory of the moving tape, and glides along the working surface of the lower calender roller. The quantity of the glue solution taken away from the fibrous tape can be controlled and regulated. The tape, soaked with glue solution and calendered, is dried, coming into contact with a heated surface, since for increasing the effect from drying, the tape is additionally calendered during drying. During drying, the dried-up glue solution upon the working elements is continuously taken away. The dried tape is put away and forms a reserve of consecutively pushed away concentric windings, which are unwound periodically at a greater speed than that at which they were wound.

The method is carried out by use of a device comprising a feeding pair of rollers next to which there is placed a jet for false twisting with a tangential slot for the entrance and openings for the passage of the tape, and the entering slot has a greater section, so that the air flux can be oriented towards the twisted part of the false twisted tape, situated between the jet false twisting and the pair of tape feeding rollers.

At a distance from the jet for false twisting, along the same axis, there is disposed the jet for laying on the glue solution with an outgoing opening, pouring-in opening, and an opening for feeding the glue solution.

To the upper part of the jet for laying on the glue solution coaxially there is connected a tube, which outgoing opening is on a lower level than the pouring-in opening. The inner walls of the jet are conical.

Immediately next to the jet for laying on the glue solution there are placed one upon the other calender rollers for taking away the glue solution with a length of the generant at least three times the width of the tape, as the upper calender roller is pressed by a spring towards the lower one. The latter has a greater diameter than that of the upper calender roller and is under the influence of a cleaning blade pressed by a spring against it. The lower calender roller has a smooth cylindrical surface and the upper roller can have a smooth surface as well as a lined cylindrical surface when a smaller quantity of glue solution is needed to be taken away from the tape.

The jet for laying on glue solution and the calender rollers for taking away the glue solution are in a protective enclosure, which has an opening for recirculation of the glue solution and an opening for the tape which is partially covered up by a movable plate. Inside the enclosure there is a protective bar, just after the calender rollers, crossing the mutual tangent of the calender pair of rollers and the drying cylinder in order to deviate the tape upwards and to limit the going-out of glue drops from the protective enclosure.

Upon the cylindric surface of the drying cylinder there is fixed a cleaning button, which is on the circumference thereof, and is defined by the tangential point of the mutual tangent of the calender rollers and the drying cylinder, coinciding with the path of the tape.

The height of the cleaning button is equal to the distance between the drying cylinder and the dividing shaft located above it for forming the consecutive windings.

The surface of the drying cylinder is entirely covered with plastic material, i.e. "Teflon", and towards it is spring pressed a calender roller also covered with "Teflon".

Towards the drying cylinder there is directed a dividing blade, which crosses the tangential area formed by the windings of the tape between the drying cylinder and the cross shaft.

After the drying cylinder there is placed a thread guiding tube, which connects it with a tubular flyer for forming a reserve upon the conical bushings of bars immovably fixed to one and the same plate, to which plate there are driven rotary pushers with inclined surfaces, which centers are crossed by a general tangent of two adjacent bars and are in one and the same plane with the lower, outgoing end of the flyer. In diametrical opposition at the two sides of the bars there are installed a photo cell and a photo-source.

The advantages of the present invention are that the method creates conditions for avoiding the soiling of the working elements, because the tape is soaked with glue solution, coming into contact with it under the top level of the glue and in a preliminarily tightened condition. A good distribution and penetration of the glue solution in the inner side of the tape is guaranteed for a comparatively short stay period of the said tape in this solution. This allows a high linear speed of the device-200 meters per minute when no breaking of the tape occurs in the spinning part.

Continuous operation of the device is ensured when tying together the ends of a broken thread when winding, thus avoiding the conditions for scorching the tape upon its stay on the drying cylinder; conditions are created for the controllable guiding of the tape; as a result there is obtained a strong and uniform yarn.

A preferred embodiment of the apparatus of the present invention is illustrated in the accompanying drawings, where:

Figure 1:
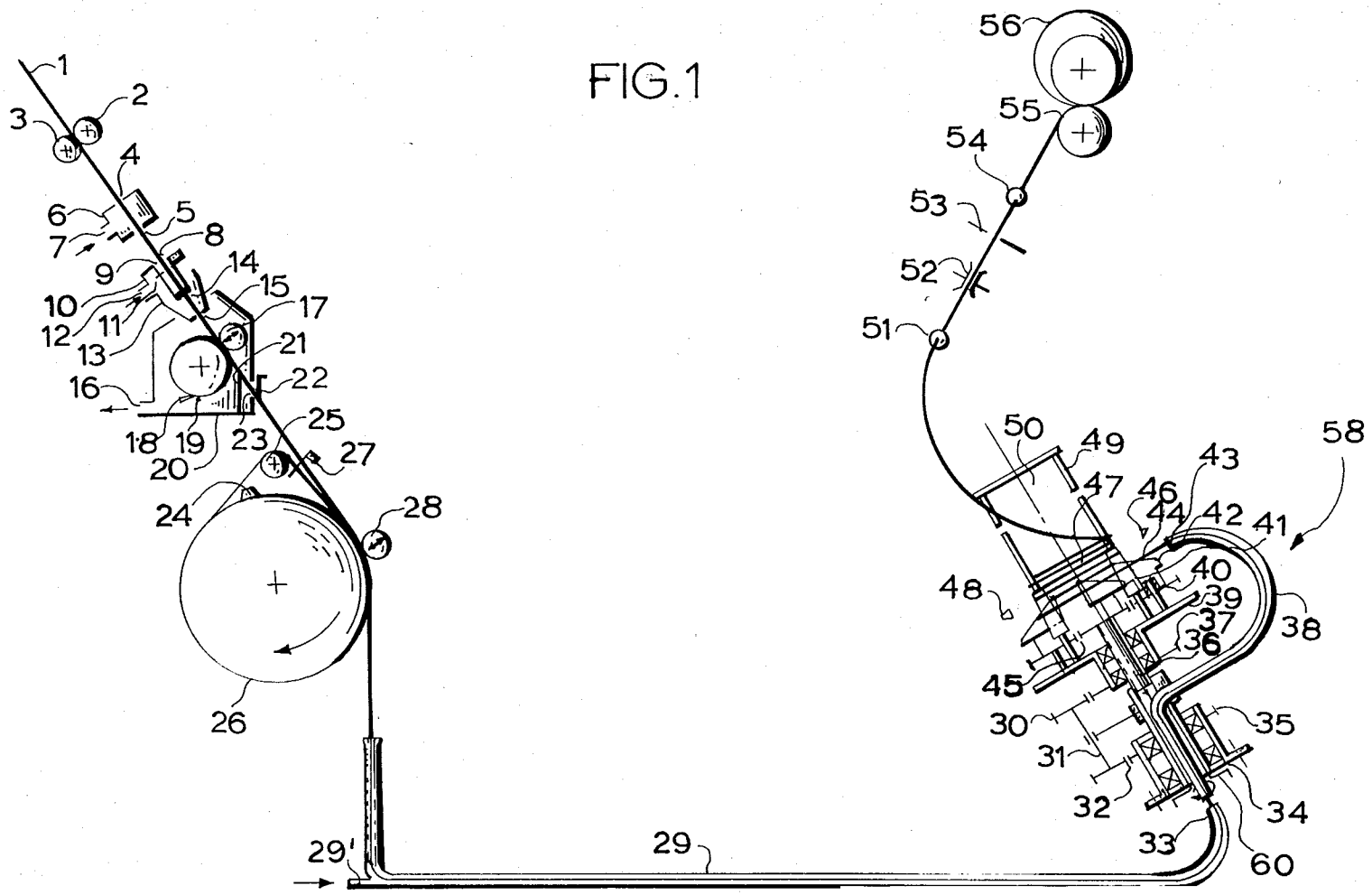
FIG. 1 illustrates in schematic form the working elements of the apparatus.

The preferred embodiment of the apparatus in accordance with the invention shown in the drawings comprises a feeding pair of rollers 2, 3 after which, along the line of their tangent, there is axially disposed a jet 6 for false twisting with a tangential slot 7 for air and oppositely placed along the axis an entering opening 4 for the tape and an outgoing opening 5 for the tape 1, the entering opening 4 having a greater cross-sectional area than the outgoing opening 5. The jet 6 causes the tape 1 to gyrate during its travel past such jet.

At a distance from the false twisting jet 6, along the same axis, there is located a jet 10 for laying on the glue solution, jet 10 having an opening 12 for feeding the glue solution, a pouring-in opening 11, and an outgoing opening 15 for the tape 1. A tube 9 with an opening 8 for the tape and an outgoing opening 14 for the tape is disposed along the same axis; the outgoing opening 14 is disposed at a lower level than the pouring-in opening 11. The lower walls 13 of the jet 10 are of frusto-conical configuration, converging in the downward direction as shown.

Immediately downstream of the jet 10 there are disposed calender rollers 17, 19 for taking away the glue solution, the direction of the mutual tangent of such calender rollers coinciding with the general tangent of the feeding pair of rollers 2, 3 along which, as we have seen above, there are disposed the jet 6 and the jet 10. The length, that is, the width of the calender rollers 17, 19 for taking away the surplus glue solution is at least equal to three times the width of the fibrous tape 1 when such tape is squeezed between the rollers 17, 19 by the thrusting of the upper roller 17 downwardly by a spring toward the lower calender roller 19. The diameter of the lower calender roller 19 is greater than the diameter of the upper calender roller 17. A spring pressed cleaning blade 18 is constantly thrust against the lower surface of the calender roller 19. The lower calender roller 19 has a smooth cylindrical surface, and the upper calender roller 17 can be made either with a smooth cylindrical surface, or, in some cases, with a grooved one, the latter construction being employed when a smaller quantity of glue solution is needed to be taken away from the tape 1.

Downstream of the calender rollers 17, 19 there is disposed a cross bar 21 with the upper edge of which the tape 1 comes into engagement in its travel from the calender rollers 17, 19 to a drying cylinder 26.

The jet 10 for laying on the glue solution, the calender rollers 17, 19, and the protective bar 21 are located in one and the same protective housing 20, which has an opening 23 through which the tape 1 leaves the housing 20 and an opening 16 for the discharge of the glue solution for recirculation. A movable lamella or plate 22 is disposed on the housing 20 above the opening 23 therein, and the protective bar 21 is fixed immovably to the base of the housing 20. Above the drying cylinder 26 there is located a dividing or stripping shaft 25 for forming consecutive windings of the tape, the axis of shaft 25 being parallel to the axis of the drying cylinder 26.

Upon the circular cylindrical surface of the drying cylinder 26, along the line of the first engagement of the fibrous tape 1 therewith, there is immovably affixed a cleaning button 24 having a radial height which is equal to the distance between the circumferential surface of the drying cylinder 26 and the lowermost portion of the circumferential surface of the dividing shaft 25.

The cleaning button 24 is in its circumference defined by the tangential point of the mutual tangent of the calender rollers 17, 19 and the drying cylinder 26, which tangent coincides with the path of the tape 1. A spring pressed calender roller 28, also covered with "Teflon", is pressed against the drying cylinder 26. An immovable dividing blade 27 crosses the tangent area between the drying cylinder 26 and the dividing shaft 25.

Downstream of the drying cylinder 26 there is disposed a thread-guiding tube 29 with an aspiration entry 29' for the starting up of spinning, the outlet end of the thread-guiding tube 29 being bent upwardly into alignment with the lower, straight and axially disposed end of a rotatable, driven flyer. The exit end 33 of the tube 29 is bent upwardly so that it is disposed coaxially of the rotatable main shaft 36 of a twisting spindle 58. Spindle 58 has a tubular flyer 38 with a straight lower portion thereof disposed within an supported coaxially by the main spindle shaft 36. The lower end of such straight portion of the flyer may be connected by a rotatable connector (not shown) to the exit end 33 of the tube 29.

The lower end of the main shaft 36 is supported for rotation with respect to a support 35 by bearings, as shown; shaft 36 is driven by a driven belt (not shown) running over pulley 60 on the shaft. A plate 39 is mounted upon an intermediate portion of the spindle shaft 36 by bearings, as shown, plate 39 being held from rotation by a conventional gearing arrangement formed by a gear 35 immovably secured to the fixed support 34, a shaft 31 extending parallel to the shaft 36 and offset with respect thereto, shaft 31 being supported upon a shaft 36 so as to rotate therewith, a gear 32 on the lower end of shaft 31 meshing with the fixed gear 35, and a gear 30 on the upper end of shaft 31 meshing with a gear 37 affixed to a sleeve which is integrally connected to the plate 39.

Figure 2:
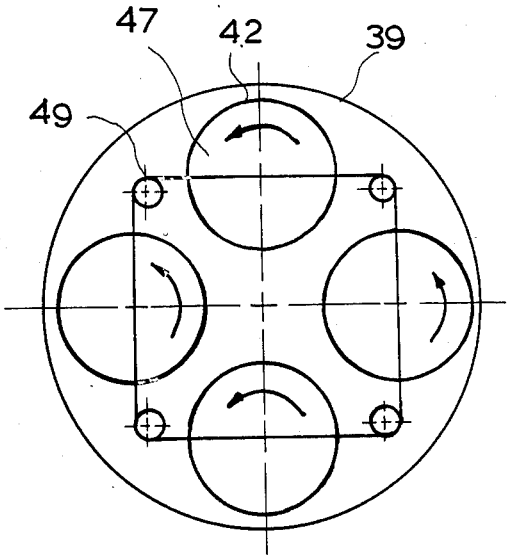
FIG. 2 illustrates the wound-in reserve tape.
Figure 3:
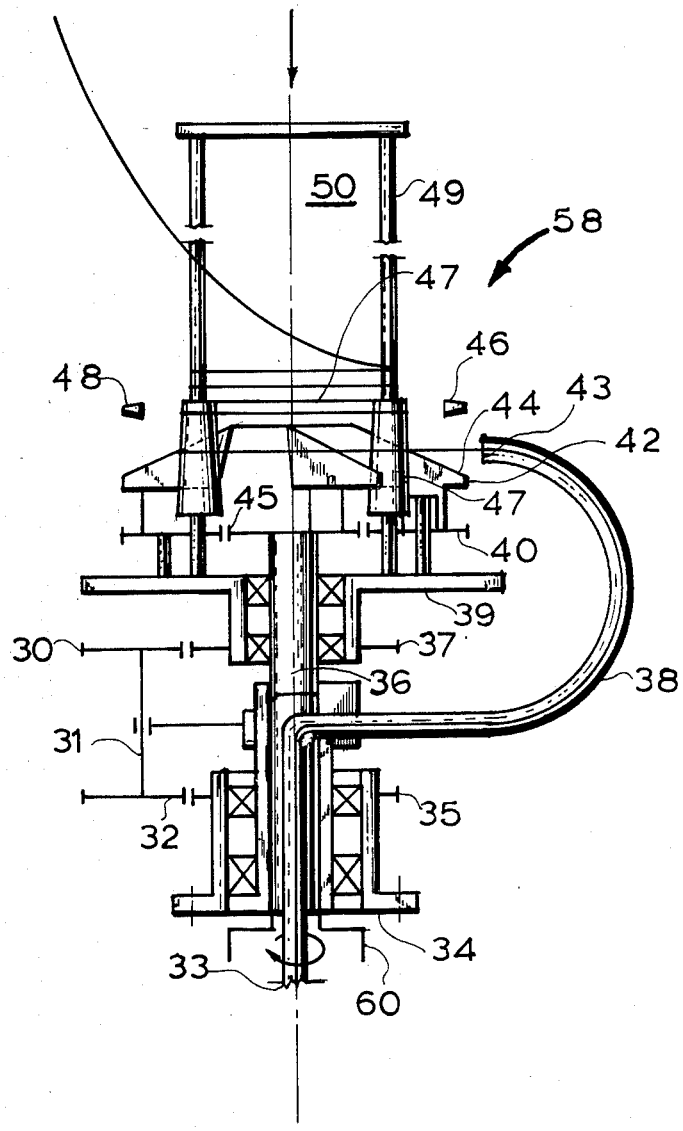
FIG. 3 is a fragmentary view on an enlarged scale of the spindle of FIG. 2.

Supported upon the immovable plate 39 are four upstanding bars or rods 49 which are equally angularly spaced around the axis of the shaft 36 and the plate 39, as shown in FIG. 2. Upwardly converging frusto-conical bushings 41 are fixedly mounted upon the respective bars 49. It will be apparent that as the flyer 38 revolves around the bars 49 and the frusto-conical bushings 41 mounted thereon the tape discharged from the upper end of the flying 38 is wound upon the frusto-conical bushings 41, thereby forming a plurality of turns 47 of twisted yarn or tape, such turns constituting a yarn reserve. Turns 47 are periodically thrust upwardly along the bushings 41 and thence along the bars 49 by pushers 42 which are rotatably mounted upon plate 39 through the medium of bearings; pushers 42 have inclined front or upper surfaces 44 which are crossed by the general tangent to the two adjacent bars 49 and are in the same plane as the lower outgoing edge 43 of the flyer 38. The pushers 42 are rotatably driven by the main shaft 36 of the spindle through the medium of meshing gears 40, 45, gear 40 being fixedly secured to each one of the pushers 42, gears 40 meshing with a single central gear 45 which is affixed to the upper end of the main spindle shaft 36.

A photo-electric cell 48 and a light source 46 are mounted by means not shown diametrically opposite each other on the outer side of the bars 49 of the yarn reserve device 50 which is made up of the bars 49 and the frusto-conical bushings 41.

Upon leaving the yarn reserve 50, the yarn passes sequentially through a thread guide 51, a brake 52, a cleaner 53, and a thread guide 54. After leaving thread guide 54 the yarn travels to a drum 55 which winds it on a bobbin 56. The number of concentric windings 47 of the yarn or tape in the yarn reserve is cyclically changed depending upon the winding itself.

The apparatus of the invention operates in the following manner in carrying out the method of the invention:

The tape 1, consisting of separate interrupted or unbroken fibers, leaves the feeding pair of rollers 2, 3 and enters the jet 6 for false twisting, where, under the influence of air coming in through the tangential opening 7, it receives a rotative movement and as a result of this twisting in the zone between the feeding pair of rollers 2, 3 and the jet 6 for false twisting the outgoing air from the jet 6 for false twisting is directed toward the twisted part of the tape 1, so that the parallelism of the fiber is not disturbed. Due to the elastic influence of the air in the jet 6 for false twisting upon the tape 1, and due to the shortening of the tape after it has been twisted, the tape 1 is directed to the center of the air vortex. As a result of that, the resisting moment of the tape 1, created by the elastic relaxation forces of said tape, becomes periodically equal to the rotating moment of the air flux, and due to it after the point of twisting cause left and right twists to be imparted to the tape 1.

Upon leaving the jet 6 for false twisting, the tape 1 passes with a rotative movement through the entering opening 8 of the tube 9, and enters the jet 10 for laying on the glue solution, where, due to the movement of the tape, all fibers in it are covered with the glue solution.

In order to avoid the separation of lint on the inner walls 13 of the jet 10 for laying on the glue solution, the tape enters under the top level of the glue solution, such level being determined by the pouring-in opening 11; also to avoid the drying-up of the glue solution upon the walls 13, the glue solution is fed through the opening 12 with a pressure which is kept by the jet 10 for laying on the glue solution constantly filled during its action. Because upon the stopping of the process the flow of pouring out of the solution through the outgoing opening 15 of the jet 10 for laying the glue solution is smaller than the flow of pouring-in through the opening 12 for feeding the glue solution, to prevent the coming back of the glue solution through the entering opening 8 of the tube 9, the said solution runs out through the pouring-in opening 11.

The tape 1, now covered with glue solution, leaves the jet 10 for laying on the glue solution through the outgoing opening 15, carrying with it part of the glue solution, and then enters between the calender rollers 17, 19 for taking away a part of the laid on glue solution.

By the pressure between the calender rollers 17, 19 and by the type of surface of the upper calender roller 17, the extent to which the surplus glue solution is partly taken away from the tape 1 is determined. The taken away glue solution constantly pours over the calender rollers 17, 19 and prevents the drying up of glue solution upon their surfaces.

The cleaning blade 18 removes the laid on glue solution from the surface of the lower calender roller 19, such removed solution runs out through the recirculation opening 16 of the protective housing or enclosure 20. During its rotation, the upper calender roller 17 automatically cleans itself.

The soaked and calendered tape 1 glides along the protective bar 21 and the movable lamella or plate 22, which limits the escape of glue drops from the protective housing 20, and then comes into engagement with the drying cylinder 26 covering simultaneously the drying cylinder and the dividing shaft 25 for the formation of consecutive windings. The cleaning button 24 periodically touches the "Teflon" covering of the shaft 25, and cleans the dried-up glue solution from its cylindrical surface.

In order to increase the drying effect of the drying cylinder 26, the tape 21 is subjected to additional calendering upon cylinder 26 by the pressure roller 28. For making easier the unwinding of the tape 1 from the drying cylinder 26, between the last windings on such cylinder there is put into action a dividing blade 27 which cuts off the stuck-together projecting fibers between adjacent windings.

The dried up tape 1 is carried through the thread guiding tube 26 to the flyer tube 38, which during its rotation winds the tape 1 around the frusto-conical bushings 41 of the bars 49, thereby forming concentric windings 47 with the rotation of the main spindle shaft 36. The pushers 42 rotate around their axes and with their inclined front surfaces 44 consecutively push the last formed coil of winding 47 upwardly along the frusto-conical bushings 41 and thence upwardly along the bars 49, thus arranging the windings 47 one after the other and thus arranging yarn reserved windings 47 one after the other, as constantly controlled by the photo cell 48 and light source 46. The tape 1 is freely unwound from the yarn reserve windings 47 and passes through the thread guide 51, brake 52, cleaner 53, and thread guide 54. From thread guide 54 the yarn passes to the drum 55 which winds it on the bobbin 56. The number of concentric windings 47 in the yarn reserve is cyclically changed depending upon the winding itself.

Although the invention is illustrated and described with reference to a preferred embodiment thereof, it is to be expressly understood that it is in no way limited to the disclosure of such preferred embodiment but is capable of numerous modifications within the scope of the appended claims.

I claim:

1. In a method of producing twistless yarns from glued together separate fibers, wherein continuously fed tape is impregnated with a glue solution, a part of the glue solution is removed from the tape, and then the tape is dried and wound onto a package, the improvement wherein the continuously fed tape is first fed in a straight line, during such straight line initial travel the tape is gyrated in a span thereof and is false twisted, a glue solution is then laid upon the false twisted tape by immersing the false twisted tape and causing it to travel downwardly through a pool of glue solution, then part of the glue solution is removed from the tape by the simultaneously calendering of the tape, and thereafter deviating the tape from the straight line of its initial travel, drying the tape, winding the dried tape into a tape reserve, and withdrawing the tape from such tape reserve and winding it into a package.

2. A method according to claim 1, wherein the tape is gyrated during its initial straight line travel under the influence of a whirling air flux fed tangentially into a limited area under constant pressure.

3. A method according to claim 2, wherein the whirling air flux is directed oppositely to the direction of gyration of the tape.

4. A method according to claim 2, wherein the tape in passing through the glue solution performs a gyratory movement.

5. A method according to claim 1, wherein the glue solution is kept at a constant level.

6. A method according to claim 1, wherein part of the glue solution is directed to a device for removing a part of the glue solution from the tape.

7. A method according to claim 1, wherein the drying of the tape is performed by a drying device, and the dried up glue solution is continuously removed from the drying device.

8. A method according to claim 1, wherein the dried up glue solution is continuously removed from the device for forming the consecutive windings which make up the tape reserve.

9. A method according to claim 1, wherein during the drying the tape is subjected to additional calendering.

10. A method according to claim 1, wherein the reserve is wound into the form of consecutive concentric windings, and periodically pushing the concentric windings axially together.

11. A method according to claim 1, wherein the reserve is unwound periodically with a speed greater than the speed of its winding.

12. Apparatus for producing twistless yarns from glued-together fibers, comprising pairs of rollers for feeding a tape formed from fibers, a device downstream of the feeding rollers for impregnating the tape with a glue solution, means downstream of the device for impregnating the tape with glue solution for removing a part of the glue solution from the tape, followed by a drying cylinder and a winder, along the mutual tangent of the feeding pair of rollers and downstream therefrom there are located consecutively a jet for false twisting the tape by air, a second jet comprising said means for impregnating the tape by a glue solution, said second jet having a tube containing glue and through which the tape enters at the upper surface of the glue solution, a pair of calender rollers, and said drying cylinder following said second jet.

13. Apparatus according to claim 12, wherein the drying cylinder is provided with a dividing shaft for the formation of consecutive windings, followed by means for winding a tape reserve and finally for withdrawing the tape from the tape reserve and winding it upon a bobbin.

14. Apparatus according to claim 13, wherein the jet for false twisting has a tangential opening for feeding an air flux under pressure thereinto.

15. Apparatus according to claim 14, wherein the entering opening for the tape into the jet for false twisting has a larger cross-section than the outgoing opening thereof for the tape.

16. Apparatus according to claim 13, wherein the jet for impregnating the tape with glue solution is separated from the jet for false twisting the tape.

17. Apparatus according to claim 13, wherein the jet for impregnating the tape with glue solution has an opening for feeding the glue solution, a pouring-in opening, and an outgoing opening for the tape.

18. Apparatus according to claim 17, wherein the outgoing opening of the jet for impregnating the tape with glue is disposed on a lower level than the pouring-in opening of the jet for impregnating the tape with glue solution.

19. Apparatus according to claim 18, wherein the inner walls of the jet for impregnating the tape with glue solution are of conical configuration.

20. Apparatus according to claim 13, wherein the calender rollers have a mutual tangent, such mutual tangent coinciding with the mutual tangent of the feeding rollers.

21. Apparatus according to claim 20, wherein the calender rollers are pressed against one another by a spring.

22. Apparatus according to claim 21, wherein the diameter of the lower calender roller is greater than that of the upper calender roller.

23. Apparatus according to claim 22, wherein the calender rollers have smooth cylindrical surfaces and have a width equal to at least three times the width of the tape as the tape is flatened there between.

24. Apparatus according to claim 22, wherein the upper calender roller has a lined surface with a width equal to at least three times the width of the tape as the tape is flatened by the calender rollers.

25. Apparatus according to claim 20, comprising a cleaning blade which is resiliantly urged against the surface of the lower calender roller.

26. Apparatus according to claim 20, wherein the jet for impregnating the tape with glue solution and the calender rollers are disposed within a protective housing.

27. Apparatus according to claim 26, wherein in the front wall of the protective housing there is formed an opening for the tape, and in its lowest part, in the back wall thereof, there is provided an opening for the recirculation of the glue solution.

28. Apparatus according to claim 27, wherein a movable plate is attached to the protective housing, such movable plate partially covering the opening through which the tape leaves the protective housing.

29. Apparatus according to claim 26, comprising a protective bar affixed to the protective housing downstream of the calender rollers, said protective bar touching the mutual tangent of the calender rollers and the drying cylinder.

30. Apparatus according to claim 13, wherein the drying cylinder is entirely covered with a non-sticking plastic material.

31. Apparatus according to claim 30, comprising a cleaning button attached to the cylindrical surface of the drying cylinder, the radially outer end of the button lying on a circle which is defined by the tangential point of the mutual tangent of the calender rollers and the drying cylinder, such mutual tangent coinciding with the straight line path of travel of the tape.

32. Apparatus according to claim 30, wherein the radial height of the cleaning button is equal to the distance from the cylindrical surface of the drying cylinder to the dividing shaft for the formation of consecutive windings, said dividing shaft being disposed parallel to the axis of the drying cylinder.

33. Apparatus according to claim 13, wherein the dividing shaft for the formation of consecutive windings upon the drying cylinder is covered with a non-sticking plastic material.

34. Apparatus according to claim 13, comprising a calender roller covered with non-sticking plastic material is spring pressed against the drying cylinder to cooperate therewith.

35. Apparatus according to claim 13, wherein the immovable dividing blade crosses the tangent plane which is formed by the windings of the tape between the drying cylinder and the dividing shaft.

36. Apparatus according to claim 13, wherein between the drying cylinder and the means for winding the reserve there is provided a thread guiding tube with an aspiration entry to start the spinning operation.

37. Apparatus according to claim 36, wherein the end of the thread guiding tube is directed to the inlet straight section of a hollow rotating flyer, the flyer being supported in a hollow main spindle shaft, an immovable plate supported on the spindle shaft, bars extending parallel to the spindle shaft extending from the immovable plate, concentric windings being formed upon the bars by the delivery of the tape from the exit end of the rotating flyer.

38. Apparatus according to claim 37, comprising frusto-conical bushings immovably mounted upon the bars near the roots of the latter, and means mounted upon the immovable plate for cyclically thrusting the coils of tape deposited upon the conical bushings and the bars in the direction away from the immovable plate.

39. Apparatus according to claim 38, wherein the pushers have inclined front surfaces, such pushers being rotatably driven by the main shaft of the spindle, the inclined front surfaces of the pushers being engaged by the tape as it is delivered from the exit end of the flyer.

40. Apparatus according to claim 37, comprising a photo cell and a light source disposed on diametrically opposed sides of the main shaft of the spindle, the photo cell and the light source constituting means for controlling the winding of the tape into the coils constituting the tape reserve.

* * * * *